US007819144B2

(12) United States Patent
Wotring

(10) Patent No.: US 7,819,144 B2
(45) Date of Patent: Oct. 26, 2010

(54) METHOD AND APPARATUS FOR LOADING AND CONDITIONING MATERIALS

(76) Inventor: Blake R. Wotring, 343 Castle Shannon Blvd., Pittsburgh, PA (US) 15234

( * ) Notice: Subject to any disclaimer, the term of this patent is extended or adjusted under 35 U.S.C. 154(b) by 1084 days.

(21) Appl. No.: 11/514,609

(22) Filed: Sep. 1, 2006

(65) Prior Publication Data

US 2007/0062422 A1 Mar. 22, 2007

Related U.S. Application Data

(60) Provisional application No. 60/713,318, filed on Sep. 1, 2005.

(51) Int. Cl.
*B65B 1/04* (2006.01)
*B65F 9/00* (2006.01)

(52) U.S. Cl. ..... 141/9; 141/83; 141/85; 141/198; 342/124; 414/397

(58) Field of Classification Search ..... 141/2, 141/9, 83, 94, 95, 98, 100–105, 192, 198; 342/118, 124; 414/397, 808; 73/290 V; 340/621

See application file for complete search history.

(56) References Cited

U.S. PATENT DOCUMENTS

| | | | | |
|---|---|---|---|---|
| 3,911,975 | A * | 10/1975 | van Soestbergen et al. | 141/95 |
| 4,114,441 | A | 9/1978 | Magri | |
| 4,629,392 | A * | 12/1986 | Campbell et al. | 414/808 |
| 5,215,372 | A * | 6/1993 | Milstead | 366/18 |
| 5,413,154 | A | 5/1995 | Hurst, Jr. et al. | |
| 5,587,969 | A | 12/1996 | Kroemer et al. | |
| 5,631,633 | A * | 5/1997 | Dreyer et al. | 340/621 |
| 5,749,783 | A | 5/1998 | Pollklas | |
| 5,948,979 | A | 9/1999 | Fitsch et al. | |
| 6,065,922 | A * | 5/2000 | Kato et al. | 414/397 |
| 6,097,425 | A | 8/2000 | Behnke et al. | |
| 6,196,279 | B1 * | 3/2001 | Baker | 141/98 |
| 6,198,424 | B1 | 3/2001 | Diede et al. | |
| 6,415,660 | B1 | 7/2002 | Sinz et al. | |
| 6,684,919 | B2 * | 2/2004 | Gaiser | 141/95 |
| 6,759,977 | B1 | 7/2004 | Edvardsson et al. | |
| 6,825,766 | B2 | 11/2004 | Hewitt et al. | |
| 6,828,930 | B2 | 12/2004 | Hagg et al. | |
| 6,829,932 | B2 | 12/2004 | Laun et al. | |
| 6,895,814 | B2 | 5/2005 | Benz | |
| 6,928,867 | B2 | 8/2005 | Reimelt et al. | |
| 6,986,294 | B2 * | 1/2006 | Fromme et al. | 73/865.8 |
| 7,513,280 | B2 * | 4/2009 | Brashears et al. | 141/104 |
| 2002/0095987 | A1 | 7/2002 | Lutke et al. | |

FOREIGN PATENT DOCUMENTS

| | | |
|---|---|---|
| JP | 63131091 | 6/1988 |
| WO | WO 9324847 | 12/1993 |

* cited by examiner

*Primary Examiner*—Timothy L Maust
(74) *Attorney, Agent, or Firm*—David G. Oberdick

(57) ABSTRACT

A method and apparatus for optimally loading and conditioning materials for transport is provided. Specially, the invention, in a preferred embodiment, relates to loading ash-like materials which require treatment prior to loading onto a truck or vehicle to avoid slurry spillage, overload or airborne particulate during loading or transport. The system conditions the ash-like materials by liquid additions proportional to material flow rate, truck information, slump height and/or slump weight. The system further includes a slump height or weight indicator and a communication and integration system.

7 Claims, 10 Drawing Sheets

METHOD AND APPARATUS FOR LOADING AND CONDITIONING MATERIALS

PRIORITY

This application hereby claims the benefit of provisional patent application Ser. No. 60/713,318, entitled "Method and Apparatus for Loading Fly Ash or Other Like Material(s) on a Transport Vehicle", filed on Sep. 1, 2005. Said provisional patent application is hereby incorporated by reference.

FIELD OF THE INVENTION

The present invention generally relates to conditioning and loading materials onto a transport vehicle and more particularly relates to an improved method of conditioning ash-like materials and loading the same onto a transport vehicle.

BRIEF BACKGROUND OF THE INVENTION

Many problems with known ash-like material loading systems have been encountered. First, the loading operation is often excessively dusty causing health concerns for workers inhaling the airborne particulate matter. Dry ash-like material is often on top of the slump (or pile of material) in the truck 170 and blows or drops from the truck 170 onto the plant property or highways. Further, because of gravity and over saturation with liquid, the bottom of the slump becomes wet or sticky during travel on a truck, causing an unloading hazard and an ash-like material water slurry 5 that leaks from the truck onto the plant property or onto public highways (see FIG. 3). The effects of this leakage leave an alkaline material that is generally between 0.2 inches and 3 inches thick on surfaces (see FIG. 3). Further, current operators cannot control the process because of the varying conditions of the material as it falls.

Also, in known systems, truck drivers do not know when to respond to the loading process without leaving the cab and putting themselves at risk of either inhaling airborne particulate matter or slipping on spilled material. Plants generally do not want drivers out of their vehicles during loading for safety reasons. FIG. 2 shows an example of a driver viewing slump progression in a known system.

Trucks 170 are frequently overloaded (see FIG. 1) or under loaded because the known systems are blind to the loading status of each slump. Overloading causes massive amounts of ash material 175 to fall onto the loading dock floor (see FIG. 1). When overloading or under loading occurs, the truck loads are adjusted at the plant site by an excavator or similar machine. Generally, about one out of every five loads must be adjusted before the truck is released for the road. The excavator either adds or takes away material. This process is quite costly for the plant in that it must have an excavator or similar machine on-site to accomplish the load adjustment. The company must also pay the excavator operators. Additionally, after load adjustment, the driver must reweigh, again costing time and money. The system of the present invention eliminates the need for the excavator and load adjustment process by optimal filling.

Further, in known ash conditioning systems, the water or liquid flow rate is held constant or manually controlled by the operator, while the ash flow rate varies, so the ash condition is not consistent, causing diverse water or liquid concentrations in the ash. The ash flow rate varies even when the operator is using a feeder or control valve. Water flow is not measured in known systems. Therefore, an operator frequently over saturates the ash material to avoid the visual appearance of airborne particulate in the loading bay. These known conditioning systems assume that a constant ash flow is provided through the loading chute, which is not technically accurate in most situations.

Currently, the ash empties from the silo through two valves. The valve closest to the silo is on-off (open-shut) valve, while the other valve is a control valve that is set at a static percent open position by the operator. The ash flows through this valve system into a pug mill where a constant flow of water is applied to the ash. The valve system and the pug mill are controlled on an on/off and timeout basis that is initiated by the tug of a rope located near the ash chute. Alternatively, an operator can run the process by sight or video without the rope.

When the truck is positioned under the chute, the driver or operator tugs on the rope or operates the system to allow ash to enter the pug mill and fall into the chute that leads to the truck bed. Another tug on the rope stops the pug mill input and allows the ash charge to flush through the pug mill and chute on a timeout basis. The entire process lasts for about three and a half minutes and loads about 22 tons of water and ash into the truck bed at close to a maximum rate of 400 tons per hour.

The known process further does not ensure a consistent water to ash ratio throughout the load or individual slumps as the flow of the ash constantly varies. This situation generates physically irritating dust at the plant site or on the roadways because the ratio of water to ash is too low. When the ratio is too high, ash/water slurry 5 commonly leaks from the truck 170 causing dirty conditions in the plant area as well as the need to remove the build-up from the roadways (see FIG. 3). In addition, excessively wet ash tends to stick to the truck's 170 bed, increasing the risk of truck rollover during the dumping operation.

The present invention overcomes the many disadvantages of the known systems as discussed below.

BRIEF SUMMARY OF THE PRESENT INVENTION

An object of the present invention is to provide an ash-like material loading optimization system.

Another object of the present invention is to provide improved ash-like material conditioning prior to loading and/or transport.

Still another object of the present invention is to provide an apparatus and method for improving communication and integration during loading.

Still another object of the present invention is to provide an alarm sensor system which detects problems with the loading process.

Still another object of the present invention is to optionally provide truck weight ticketing for use in the loading process.

Still another object of the present invention is to control the conditioning and loading processes based on actual truck fill rate, actual truck capacity and actual mass flow of ash-like material.

Still another object of the present invention is to control liquid flow with respect to ash-like material mass flow instead of using internal timers and valve settings.

Still another object of the present invention is to vary the conditioning of ash-like material in the truck by load position. For example, dry mix is loaded on the bottom of the truck or transport vehicle's bed so that it absorbs migrating liquid from the ash-like material above, before any ash/water slurry can leak from the truck during transport. This feature also allows ash-like material to easily slide out of the truck during dumping.

Still another object of the present invention is to anticipate load status by tracking the slump height change rate and then proactively adjusting the conditioning system based on the slump fill rate.

Still another object of the present invention is to provide a signal or display to the truck driver of when to move the truck during loading instead of him or her having to climb onto the truck to observe the fill level.

Yet another object of the present invention is to set and maintain maximum weight and height limits, specific to each truck or transport vehicle to prevent overloading or spilling.

Yet another object of the present invention is to collect the data acquired from each load to drive process improvements and efforts.

Yet another object of the present invention is to provide a plurality of extra emergency stop mechanisms around the loading chute and at the pug mill to prevent injury and spilling.

Specifically, what is provided in one preferred embodiment of the present invention is a method of loading and conditioning an ash-like material. The method comprises a material loading system providing for optimal loading of a container, a material conditioning system for optimally conditioning the ash-like material to be loaded into the container or vehicle using the material loading system, an alarm system having a plurality of sensors working in conjunction with the material loading system and the material conditioning system, and, a communication and integration system monitoring the alarm system, the material conditioning system and the material loading system. The method optionally includes a truck weight ticketing system providing truck drivers with truck weights before and after material loading.

In another preferred embodiment, a system of loading a vehicle is provided which comprises the steps of displaying a message prompting a truck driver to pull a vehicle into a loading position, starting the loading of the vehicle by pulling a rope, displaying a slump height progression during the loading of each slump, prompting the driver to move the vehicle to load a next slump by means of a display; and prompting the driver to move the vehicle from the loading position after the loading process is complete by means of the display. In a preferred embodiment, the display is a marquee. The system further comprises the step of providing a fatal and a non-fatal alarms which each locate defects in said system during said loading.

In yet another preferred embodiment, a method of loading and conditioning a material is provided. The method comprises the steps of adding a liquid material and a dry material as the loading process begins, sensing speed and slump progression through the use of a radar detector, calculating a mix shift level based on the speed and slump progression, and, restricting the flow of the dry material as the loading process reaches a target weight. Here, sensing is usually accomplished by means of a radar detector.

DETAILED DESCRIPTION OF THE PREFERRED EMBODIMENT

Figure 1:
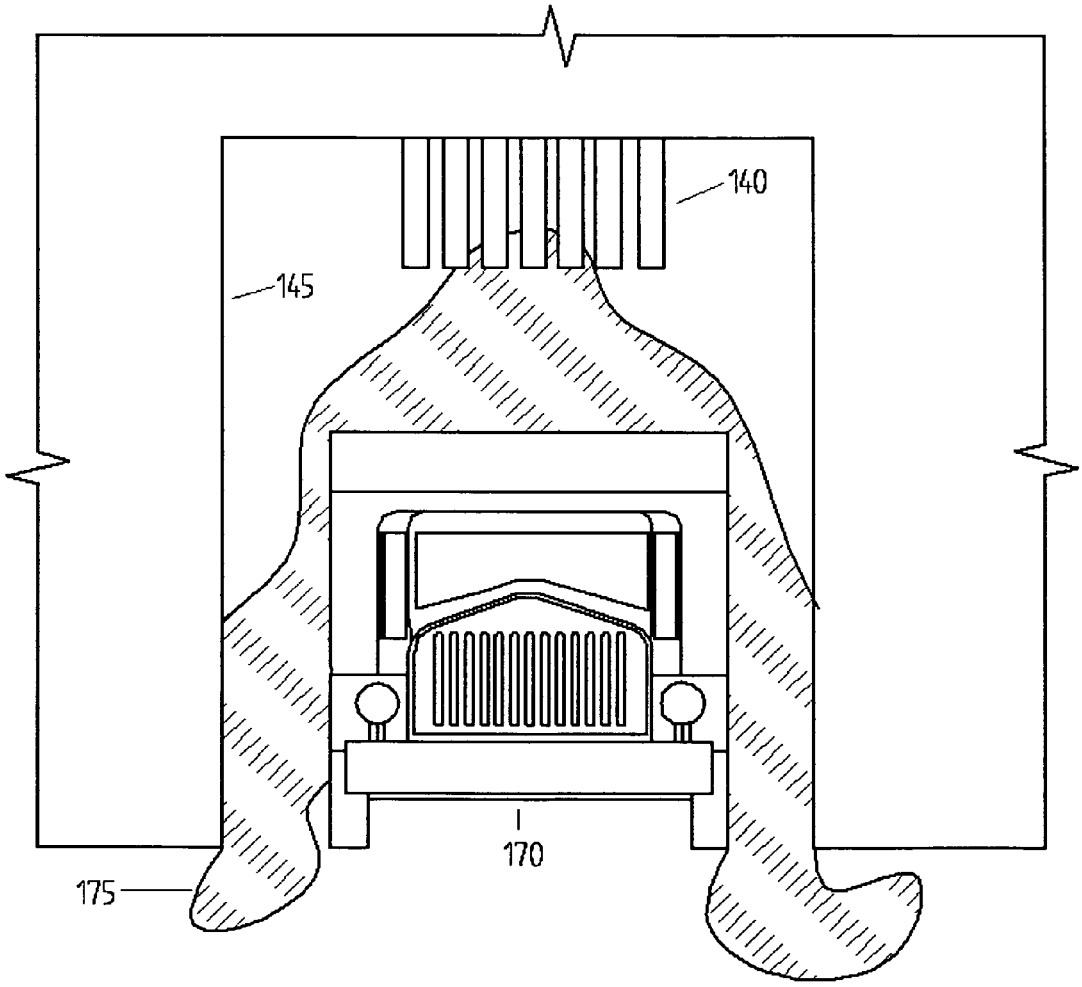
FIGURE 1 (PRIOR ART)
FIG. 1 shows a picture of truck overfilling and resulting spillage of ash-like material in a prior art system.

The invention will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications in the illustrated apparatuses and methods, and such further applications of the principles of the invention illustrated herein, as would normally occur to persons skilled in the art to which the invention relates.

For purposes of this disclosure the terms "truck" or "vehicle" shall mean any vehicle or container used to move material or that could be used to move material in the context of the invention. These terms also encompass, within their meaning, other containers used to move materials, such as railroad cars or the like.

While ash or ash-like material is used in describing the invention in a preferred embodiment, the present invention is not limited to such. For example, soils, powders, particulate and other materials which require liquid additions prior to transport are also within the scope of the present invention. The invention can also function with any type of material, even materials that do not require the addition of liquid prior to loading.

Ash-Like Material Property Definitions

- Target Mix:
  - Conditioned ash-like material with liquid content and density made optimal for transportation
- Dry Mix:
  - Conditioned ash-like material that is just wet enough to suppress a puff during loading
- Dry Mix Flush:
  - The tapering off of ash-like material flow and drying out of the material mix in the pug mill
  - It is also provides the base of the next slump
  - It is further used at the end of the process so there is not as much material in the mill during the startup operation
- Liquid Flush:
  - Complete liquid cleaning of the pug mill at the end of the day's work
- Slump Fill Rate:
  - The fill rate of a slump within a vehicle.
- Slump Height:
  - The slump height measured from the radar detector as a percentage of max slump height The automated ash-like material loading system maintains a consistently optimal loading process on a custom basis for each truck and loading bay combination. It then provides report data that enables effective management and training of the truck drivers. At least five standard sets of functions are provided by the system of the present invention: ash loading optimization; ash conditioning; communication and integration; the alarm system with sensors and optionally truck weight ticketing. Optionally, other functions can be provided as known to those skilled in the art.

The main function of ash-like material loading optimization is to provide a visual indication of the loading level of ash-like material into the bed of a truck. By limiting the number of over-loaded and under-loaded trucks, a more efficient operation is achieved. The optimized loading process also eliminates the need for an on-site excavator for load adjustment. The ash-like material loading function uses truck specific data to guide the driver in real time to an optimal load specific to his truck, container or vehicle. The data or loading truck's identity is optionally obtained from a tag on the truck as explained below.

The loading optimization process of the present invention consists of an optionally low power radar distance detector 150 ("radar detector" hereinafter) which accurately measures the distance to the container beneath and to the level of material in the container. The radar detector 150 is mounted to the ceiling of the loading bay 145 or roof of the plant, proximate to the chute 140. In this embodiment the radar detector is mounted vertically so that the radar beam contacts a side of the slump at a calibrated offset distance from the peak. This calibrated offset is added to the measured height to obtain the height of the peak. Optionally, the radar detector 150 is mounted at a slight angle from the vertical axis so that the radar beam contacts a side or the peak of the slump, and then a scaling factor is used to convert the distance measured to the corresponding vertical height of the slump. The scaling factor uses trigonometry and a calibrated offset from point measured to extrapolate the peak height of the slump. A slight angle is optionally used so that the tail gate of the truck does not break the line of sight when loading the back of the vehicle. The detector can also optionally be directed to the peak of a slump in another embodiment. Through its output signal and a small PLC (Programmable Logic Controller), a digital readout indicates to the truck driver what percentage of optimal slump height has been achieved.

When the digital display is illuminated, the truck driver sees that the system is working. In a preferred embodiment, a marquee is used to enable alpha-numeric capability, thus allowing for process directions and fault information to be given to the driver. As a truck is being loaded, the slump of ash-like material raises, and the distance to the radar detector becomes smaller. As the ash slump level increases, the percentage distance achieved increases on the digital display until that particular truck's optimum fill height percentage is reached. At this point the truck driver takes an action, which is either moving the truck forward or stopping the loading process. Optionally, the driver can back up. However, when the radar detector 150 is optionally aimed at the side of a slump instead of its peak, the driver is not permitted to back up. If he or she does back up and the radar detector is aimed at the side of the slump, the system activates an over-height shutdown alarm.

An optimal slump height for each vehicle is stored in the central hub of the system during initialization on the truck's first visit to the loading silos or bays. After initialization, the system identifies each truck by its tag, which identifies the truck and its capacities, and retrieves the truck specific optimization loading data from the central hub. The tag can be a radio frequency tag, a bar code, light scanner tag or any other type of similar identification tag that accomplishes a similar function. When the driver initiates the loading process, e.g., by pulling the rope or by other automatic means, the system informs the driver how close the current loading process is to the optimal slump size established for his or her specific vehicle. The marquee provides a "move" indication when the truck gets close to 100% height and/or weight for a particular slump. The driver then moves the truck, in a forward direction under the ash chute, until each slump reaches optimal height and/or weight and loads the full length of the truck. The system terminates the loading process automatically when the optimum weight of ash-like material for a particular truck is loaded. Optionally, an additional alarm or horn activates when the ash loading process is terminated if a truck approaches its maximum weight limit. Again, this alarm or horn can optionally be replaced with a marquee in a preferred embodiment.

Using the ash-like material loading system of the present invention in this way, the driver determines optimal slump height for his or her vehicle and is given a real time, truck specific loading percentage that enables him or her to accurately fill the bed or container to the maximum without worrying about over-loading (see FIG. 1) or under-loading.

Tri-axle vehicles generally load about three slumps, while trailers generally load three to eight slumps. Of course, the number of slumps can be increased or decreased depending on the size of the vehicle or container. The drivers can use the optional marquee to slowly move the vehicle forward during loading to thereby create one continuous ridge in the ash-like material instead of a series of slumps.

Figure 2:
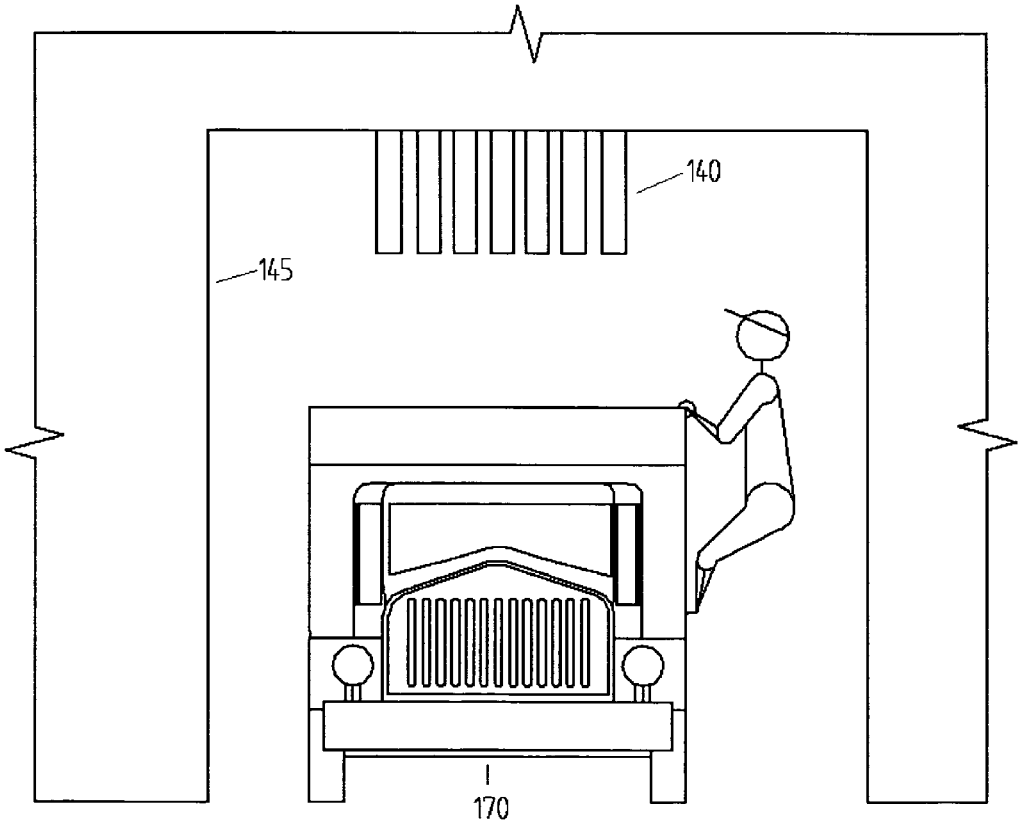
FIGURE 2 (PRIOR ART)
FIG. 2 shows a truck driver observing slump height in a prior art system.
Figure 3:
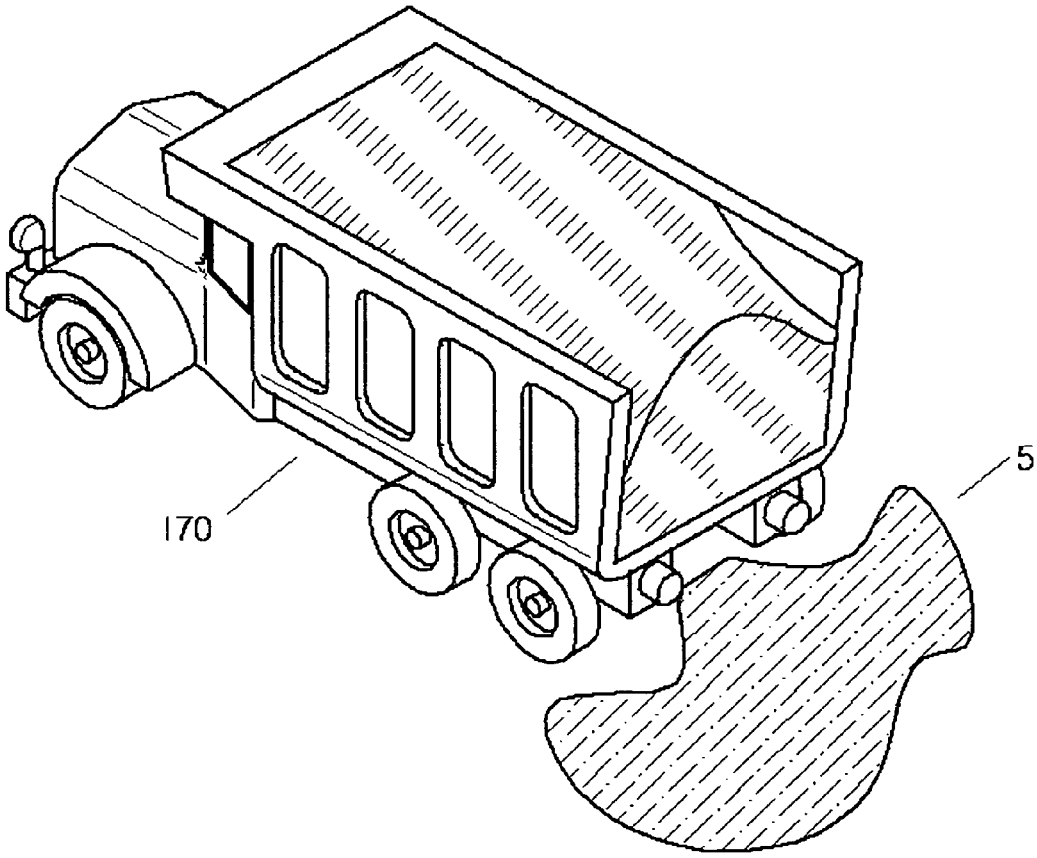
FIGURE 3 (PRIOR ART)
FIG. 3 shows a picture of the results of over conditioning in a prior art system.
Figure 4:
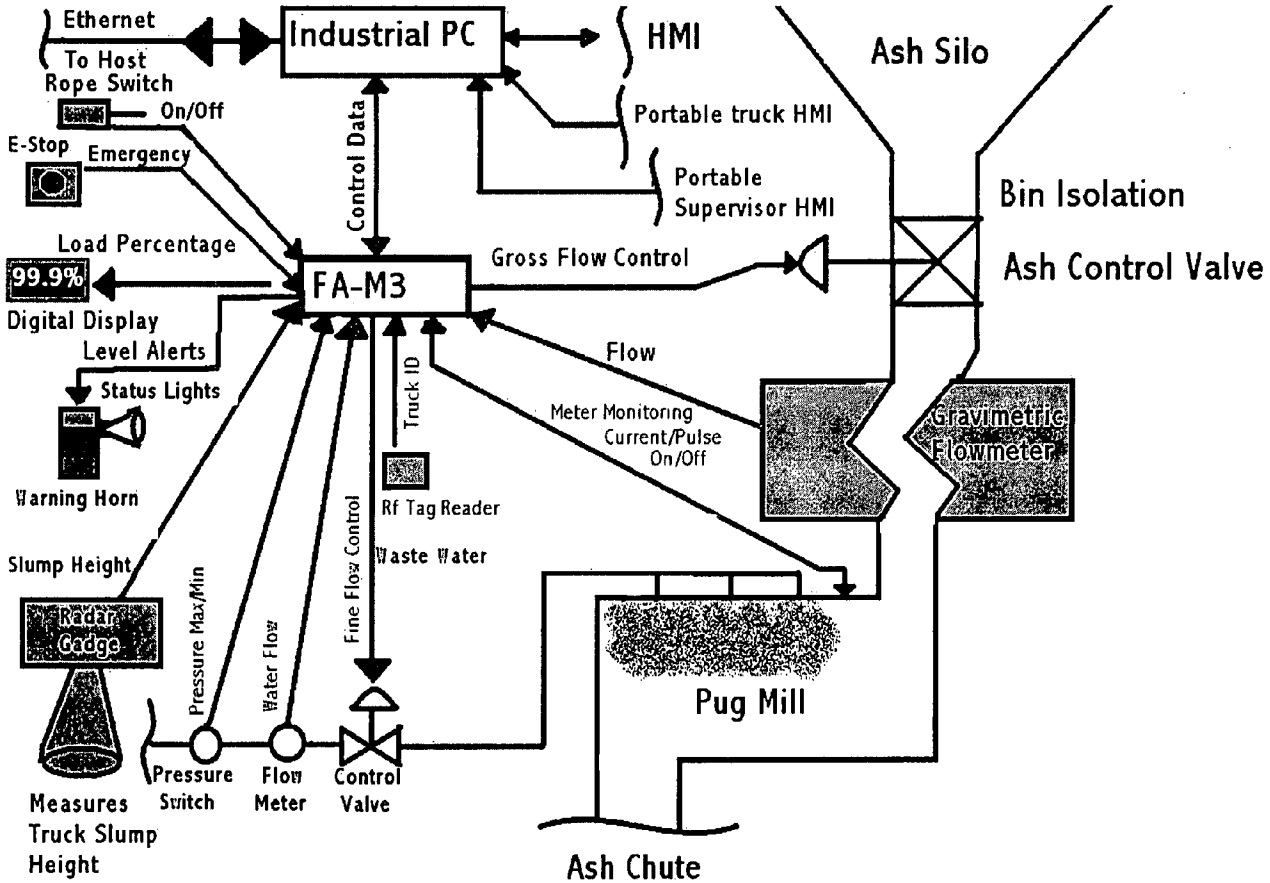
FIG. 4 shows the optimized loading and conditioning process of the present invention in a preferred embodiment.

The ash-like material loading optimization system gives the loading process control back to the truck driver. It eliminates the need for the driver to constantly climb up to the bed of the vehicle as the ash-like material is loading, exposing him or her to inhaling airborne particulate, when checking on whether the vehicle must be moved to prevent overfilling (see FIG. 2). Most companies have safety rules against the driver leaving the vehicle during loading. To prevent safety violations, the present system controls weight loading using the actual weight of ash-like material and the actual density/flow that comes out of the silo, instead of guessing with a timer or the number of revolutions of a feeder as in the known systems. With the system of the present invention, the operator is given an accurate and vehicle customized measure of ash-like material loading that is clearly visible to him as he easily controls the position of the truck from inside the safety of the truck's cab. In the currently known systems, the operator is merely guessing the weight of the loaded truck using a timer, which causes the need for load adjustment.

When the system stops for mechanical failure or because the truck driver prematurely hits the stop signal for his or her own reasons, the system knows how much more the vehicle can be loaded and the process resumes. Using known timer and feeder methods, the load progress is lost once the process is stopped and finishing the load is done by conjecture.

It is important to note that the first load of the day or after the mill has been purged is never a full load or has an accurate mixture of liquid and ash in the known systems. With the present invention, the loading system allows the operator to account for the lost mill priming weight in the first load by deducting a predetermined amount of product from the first slump of the load.

It is also important to note that this loading system can also be operated manually. The manual mode can be used to flush out the mill at the end of the day without any tapering of the ash-like material in the pug mill. In this manual mode, the operator or driver manually pulls the rope or operates the system to purge the mill of ash-like material without any tapering. The manual mode can also be used as a utility to the supervisor to top off previous loads or any other situation where he does not want to automatically determine when to start and stop the system.

Figure 5:
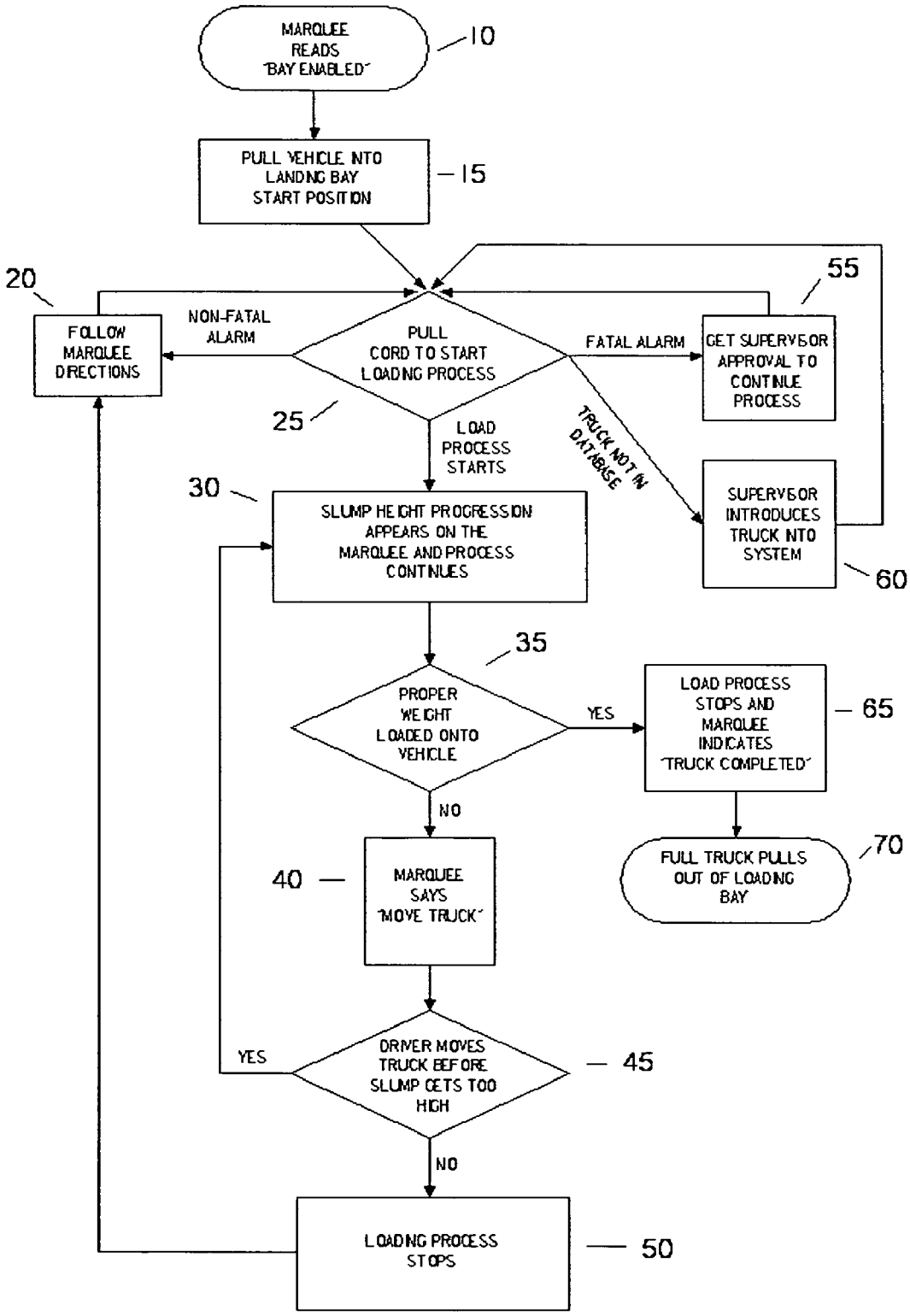
FIG. 5 discloses a flow chart of the optimized loading process.

FIG. 5, displays an example of the steps the system performs or displays during a preferred loading process. First, the marquee displays the message "bay enabled" 10, which prompts the drivers to pulling the vehicle into the start position 15. If a non-fatal alarm occurs the driver should follow the instructions that appear on the marquee 20. If a fatal alarm occurs, the supervisor or other authorized person must approve the loading for the process to continue 55. If the truck is not in the system's database, the supervisor or other authorized person introduces the truck into the system 60 and then the loading process continues.

The driver or operator pulls the rope or cord to start the loading process 25. As loading begins the marquee displays the slump height progression 30. If a proper weight is loaded into the vehicle 35, then the loading process is stopped and the marquee indicates "truck completed" 65. Otherwise the loading process continues. Once the proper slump height is loaded into the vehicle, the marquee says "move truck" 40. The driver then moves the truck before the slump becomes too high 45 and the loading process for the next slump continues at 30. If the driver does not move the truck in response to the marquee 40, the loading process stops temporarily 50 until the truck is moved.

The ash-like material at the plant must be conditioned with a liquid, preferably water, before it is removed from the plant site so that dust particulate is controlled, both during loading and during vehicle travel. The known ash loading process does not actively control the liquid content of the ash as the ash flow varies. The conditioning system of the present invention measures the ash-like material's flow rate and optimizes the liquid content of the ash-like material as it loads into the truck.

The conditioning system of the present invention mounts a dry flow measuring device in-line with the vertical drop of the ash-like material line just below the ash control valve. With this measurement, the present system accurately and dynamically controls the liquid density of the conditioned ash-like material so that the amount of liquid in the truck is enough to suppress dust, but not so excessively as to create an ash-like material liquid slurry. When linked with the vehicle loading optimization system, this function enables the system to dispense an optimally conditioned load to each vehicle while meeting the OSHA, EPA, and DOT requirements.

The conditioning of the ash-like material by the system varies depending on the height of material slump in the particular vehicle's bed. The loading process loads the desired liquid content gradient into each vehicle as the slump height progresses. The system works with the operator or driver to anticipate when he or she should move the vehicle and indicates this via the marquee or by other similar means. A fully successful loading process is one that progresses to dry mix flush once the desired load weight is being approached. Care is taken not to overload the vehicle above a maximum height or weight level and to never allow the liquid concentration to fall below a level that would produce a "puff" of dust during vehicle loading or transport. Additionally, the system senses valve failure, more particularly the liquid and ash-like material flow meters sense when liquid and ash-like material valves are not in their proper position and establishes alarm states.

The ash-like material flow through the silo above the pug mill is constantly changing as air pressure, air density, ash-like material density, and ash-like material height vary. This system changes the liquid content dynamically as the ash-like material flow and other factors change.

The ash-like material density from the silo above the pug mill is constantly changing as air content, flow obstructions, and ash-like material height vary. This system changes the liquid weight content dynamically as the material's density changes.

Figure 8:
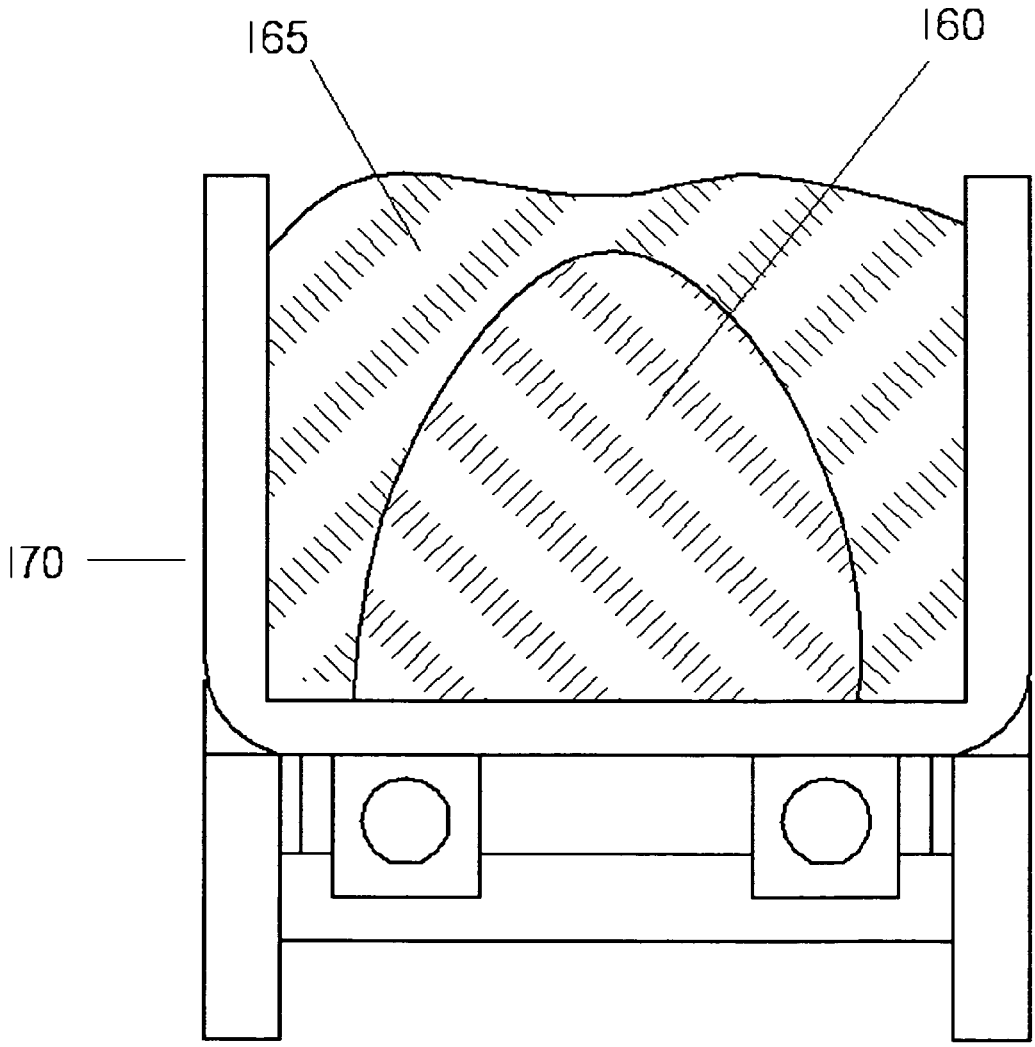
FIG. 8 displays an example of liquid concentration verses slump height.

Ash-like material loading, using the system of the present invention, allows a gradient or layers of liquid concentration to be loaded across each slump with respect to slump height (see FIG. 8). A liquid concentration gradient within the slump has three main benefits: 1) it minimizes liquid transport weight while still suppressing dusting at the top of the slump; 2) it allows easy/complete unloading by having dry ash-like material acting as a dry sliding mechanism at the bottom of each slump; 3) as the vehicle vibrates during travel, the liquid falls within the slump and a drier slump bottom 160 prevents bottom saturation and loaming (when the material being mixed with liquid is essentially fully saturated and no longer can accept the liquid) thereby eliminating slurry spillage onto the road.

The concentration gradient is accomplished through the use of a dynamically set mix shift levels (MSL) which is a level of slump height that signals the system to change the liquid concentration of the ash-like material processed in the pug mill to a previously selected mix. The time taken by the pug mill to mix the liquid with the ash presents a time lag between when the liquid and ash weights are measured to the moment that the mixture falls into the slump. The system anticipates how this time lag affects the liquid content of the slump and adds or restricts liquid flow accordingly. The MSL can optionally shift many times during a slump to provide optimal slump loading with many different layers.

Figure 6:
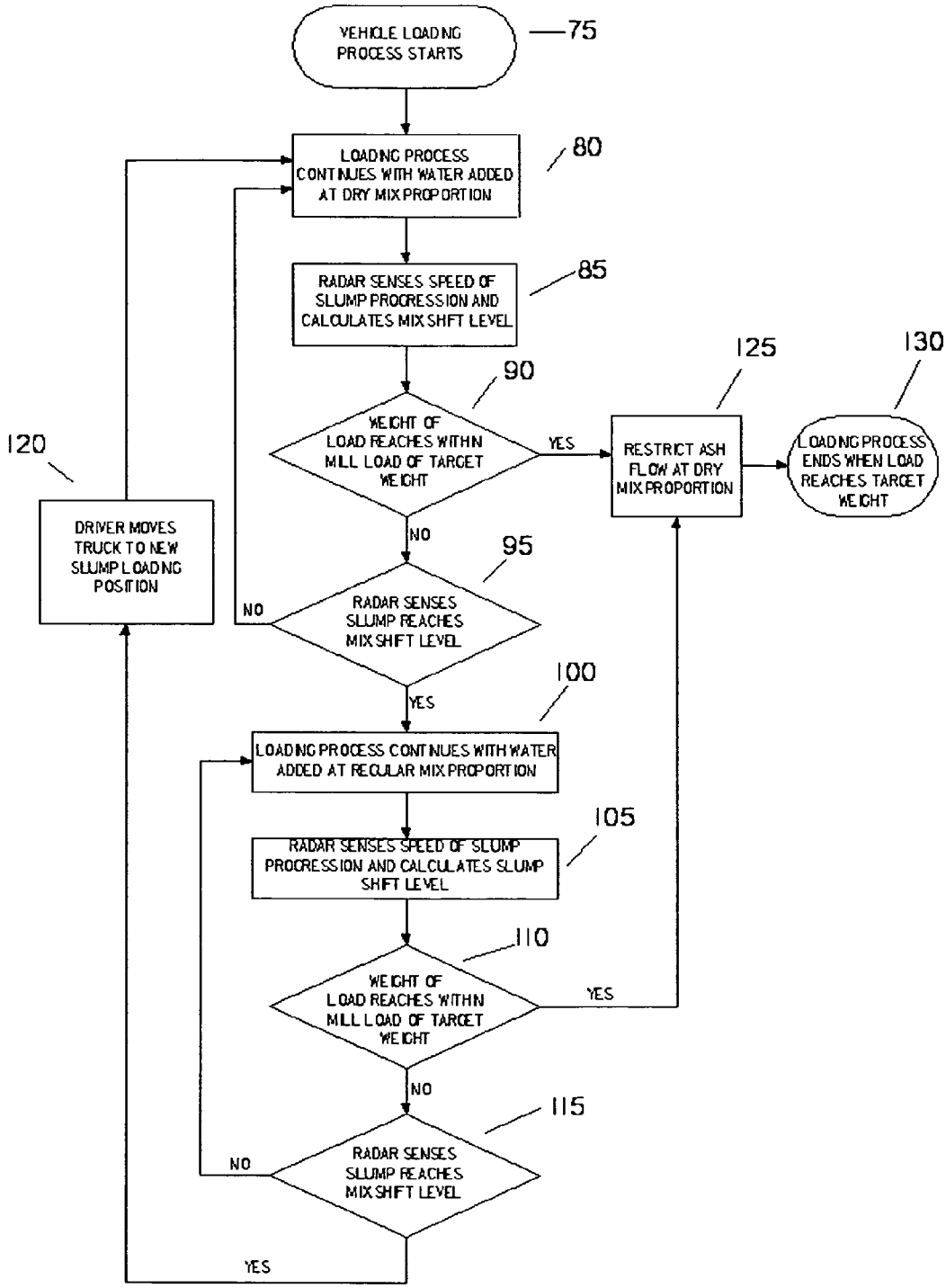
FIG. 6 shows a flow chart of one embodiment of the optimized conditioning process.
Figure 7:
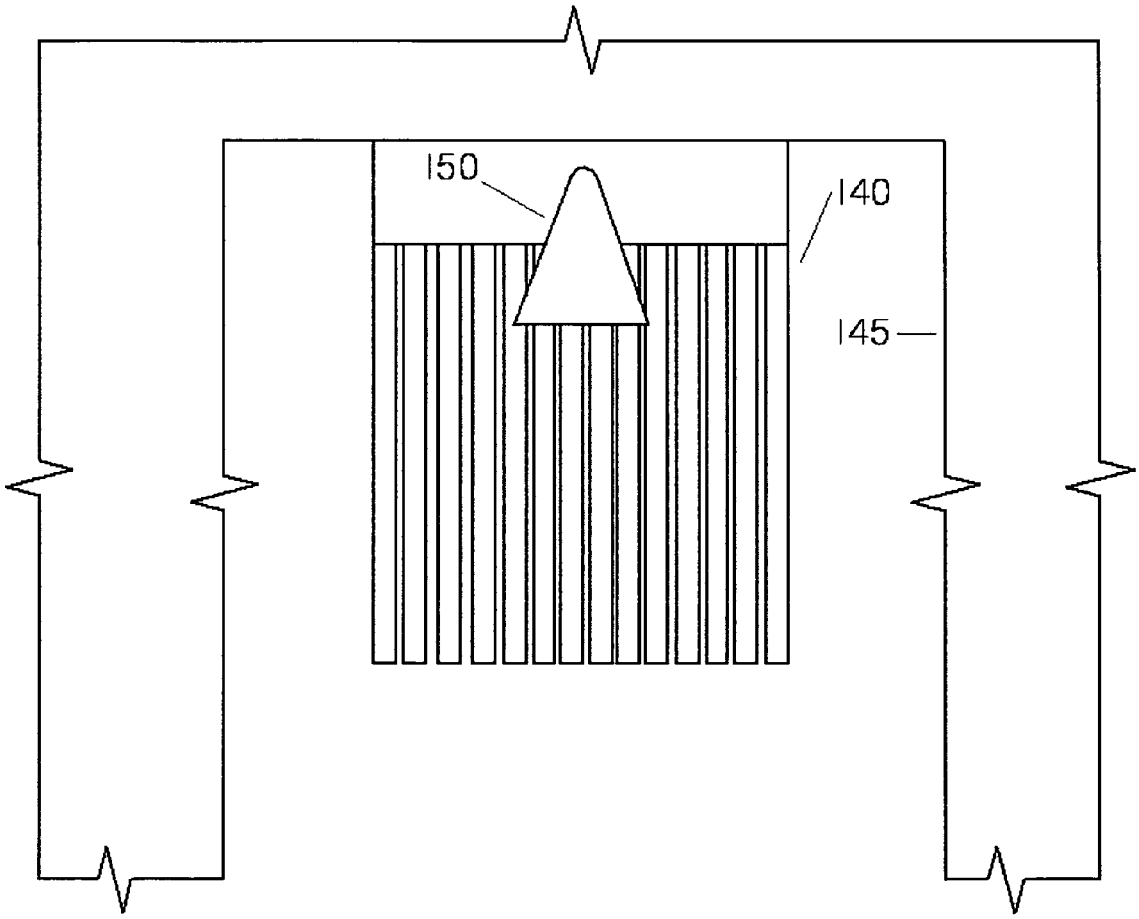
FIG. 7 shows the radar horn of the radar detector in the present invention mounted near the chute.

The mix shift level is dynamically calculated as a function of the rate of slump height increase as measured through the radar detector 150. Faster rates are occasion for proportionately lower MSLs within the slump. Alternatively, the system can calculate the MSLs using a fixed height above the bed or a percent of fill position from the top rail of the vehicle. FIG. 6 only displays one embodiment of MSL calculation.

One example is where the loading process has only one MSL that causes the slump to have a dry layer of ash-like material on the bottom 160 and a wet layer 165 on the top (as shown in FIG. 8). Alternatively, a plurality of MSLs can be established to produce more layers of differing liquid concentration that form a smoother gradient or more layers within the slump. Any number of dry/wet ash-like material layers within a particular slump can be accomplished by, and is within the scope of, the present invention.

The invention further provides liquid content management for transport. Here, a wet blanket of ash-like material 165 on the top of the load allows the bottom of the load to be drier 160 without the risk of ash-like particulate becoming airborne during transport. Less liquid in the bottom of the load means less liquid weight and correspondingly less fuel cost to transport.

Another feature of the present invention provides a dry mix flush of the pug mill based on load weight progression to the optimal load weight. Here, the present invention uses the mixing time the mill requires to anticipate when to end the loading process with a dry mix flush for the next truck loading process. The time that material takes to travel through the mill is found with experimentation during the initial construction of the system. The weight of material in the mill is calculated by multiplying the time the material must travel through the mill by the sum of the liquid and ash-like material flows. When content weight of the mill is equal to the weight required to complete the loading process, then the system gets ready for process completion by initiating a dry mix flush that lasts for a period of time equal to the time that material takes to travel through the mill. At the end of the dry flush, the loading process is completed by closing the valves, stopping the mill, and taking the other actions required to stop and log the loading process.

During a dry mix flush, the system takes at least two control actions: 1) it lowers the liquid content in the pug mill to dry mix; and 2) it tapers the flow rate of ash-like material into the pug mill to reduce the mill's material content at the end of the load as well as minimizing wear to the control valves and the mill motor.

There are at least four benefits to using a dry mix flush at the end of each loading process: 1) the current load is more accurate when there is less material in the mill when the pug mill stops; 2) the mill is prepared to dispense dry mix into the bottom of the first slump in the next truck; 3) the high motor load required to start the mill is greatly reduced when there is less material in the mill at load process initiation for the next truck; 4) the high motor load required to start the mill for the next truck is reduced when there is drier material in the mill at load process initiation for the next truck. For these reasons, a dry mix flush is used to complete each load.

FIG. 6 details an example of the loading process with the ash conditioning system in a preferred embodiment, as described below. The loading process starts 75 and begins to add liquid added mix and dry mix proportions 80. The radar detector 150 senses the speed of the slump progression and calculates a mix shift level 85. If the weight of the load reaches within mill load of target weight 90 then the system restricts ash flow at dry mix proportion 125. The loading process ends when the load reaches the target weight 130. If weight of the load does not reach this level, the radar detector 150 senses the slump weight and reaches the mix shift level 95. Here, the loading process continues with liquid added to regular mix proportion 100. The radar detector 150 then senses the speed of the slump progression and calculates slump shift level 105. Again, if the weight of the load reaches within mill load of the target weight 110, the systems restricts ash flow at dry mix proportion 125. If the weight of the load does not reach within mill load of the target weight, then the radar detector 150 senses when a slump reaches a mix shift level 115. The driver then moves the truck to a new slump loading position 120 and the process continues from 80.

The communications and integration functions of the present invention provide complete process limits and management control of the ash-like material loading process. These functions enable the system to respond in a custom way to each driver and truck. In addition, the System has Ethernet, Internet, wireless LAN or similar capability to allow communication with other systems of the present invention. This feature allows a plant controller to drive around in a vehicle and observe the loading bay while controlling the system remotely on wireless network.

Each loading bay of the present invention is controlled by a local PLC that performs the loading and conditioning functions in an uninterrupted, redundant manner. For example, if one loading bay is taken offline, all the other bays stay in operation. All the local PLCs report to a central PC which is the central control hub. Optionally, a local PLC can control more than one loading bay or all loading bays.

One function of the central hub is to store and communicate the loading process data of each load for review by a manager. Communication to a manager is accomplished by the central hub through a file transfer to a CD, PC, over the Ethernet, Internet, wireless LAN connection or via similar means. Process data includes but is not limited to: truck tag ID (truck data key); loading time and duration; loading bay used; ash-like material to liquid density before or after flush; weight of ash-like material in the load; estimated weight of liquid in the load; occurrence of any alarms or warnings during the loading process; and process set points established for this load. Other process data known to those skilled in the art can also be tracked and reviewed by the manager.

Another function of the central hub is to store and communicate process set points to the PLC's. Process engineers set optimal process set points by bay or by truck using this function. Changes in these set points are made by a password qualified engineer and communicated to each PLC for use in the next loading process. The set point data includes but is not limited to: loading bay ID (bay data key); optimal ash-like material to liquid density for each loading bay; flush time (or liquid volume) for each loading bay; bay specific control system tuning data, and other set point data know to those skilled in the art.

It is important to note that the system must coordinate loading bay data for a particular time with the truck being loaded at that time. For example, the same truck loaded at two different times, even in the same loading bay, may have different loading parameters in that the ash-like material output from the chute 140 is constantly changing. Further, two identical trucks loaded in two different bays, at the same or different times, would require different loading parameters, again because of variations in the ash-like material output.

The process engineer has the ability to flexibly adjust any set point data using the central hub interface to achieve optimum conditions in the bay or on a truck by truck basis. Alternatively, set point data is sent to the central hub, optionally, on a password secured basis, over an Ethernet, Internet, wireless LAN connection or via a like connection. In any case, the ash-like material loading automation system ensures the quality of consistency to these set points for each load.

Figure 9:
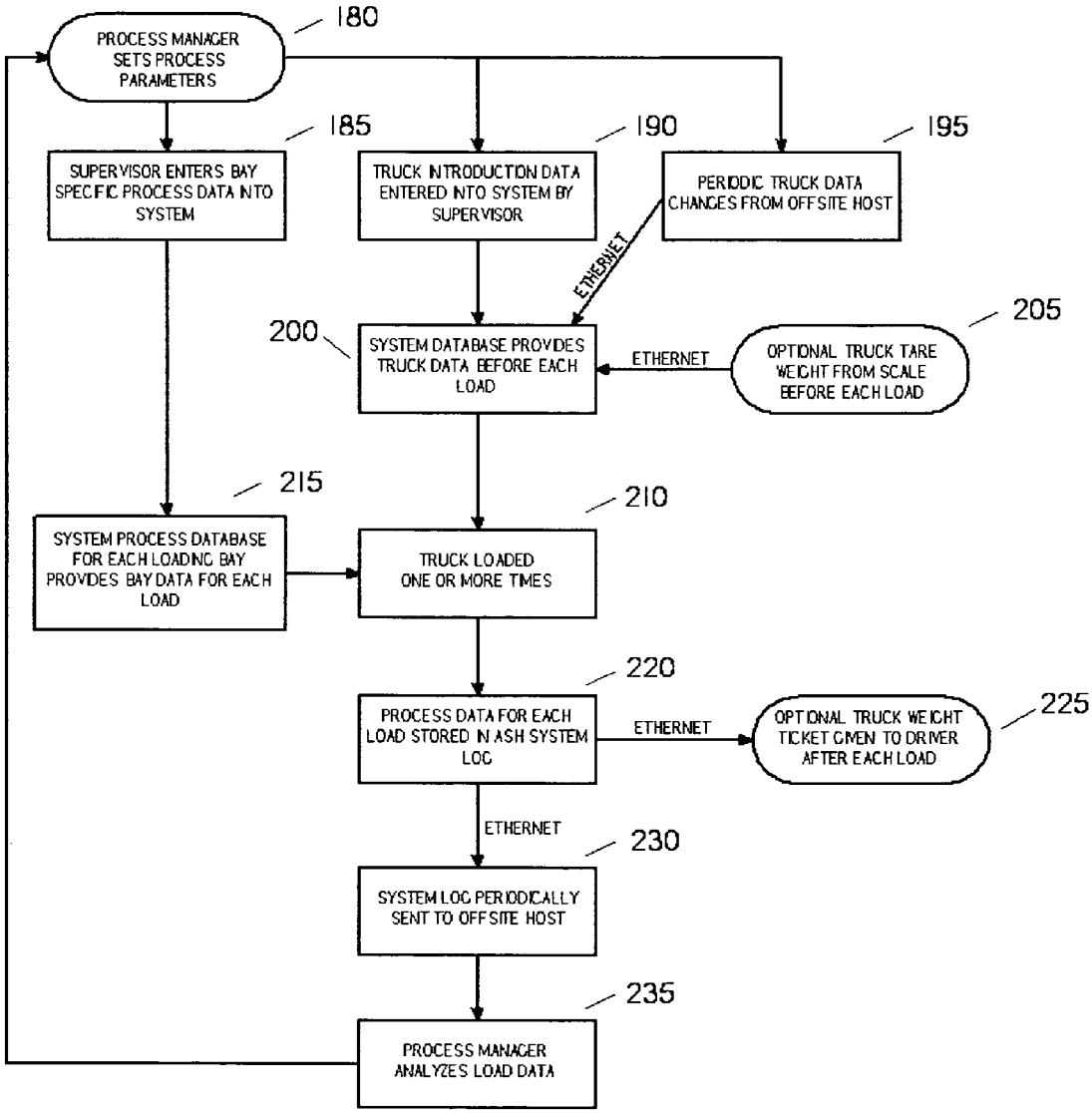
FIG. 9 shows a flow chart of the process data cycle.

Referring now to FIG. 9, a preferred embodiment of the process data cycle is disclosed. First the process manager sets the process parameters 180. Then, if it is a new truck, it is introduced into the system by a supervisor 190. Optionally, periodic truck data changes from an offsite host are also incorporated into truck data inputted into the system 195. Next, the supervisor enters the bay specific process data into the system 185. This daily bay specific process data constantly changes throughout the loading day. The system truck database provides truck data before each load 200 and optionally truck tare weight from the scale before each load 205. Next, the system processes data for each loading bay and provides loading bay data for each load and/or slump 215. The truck is then loaded one or more times 210 until full. After loading, the process data for each load is stored in the system log 220. Optionally truck weight is given to the driver after each load 225. The system log is periodically sent to an offsite host 230 and the process manager analyzes load data 235.

The alarm system is another component of the present invention. The alarm system is comprised of a plurality of sensors which determine if the system is functioning properly and if the driver has positioned and readied the truck for loading in a proper manner. It further detects broken liquid and ash valves and warns the operators if such a defect is found. This system also detects and prevents such things as: "drive-aways" by the truck driver, which causes tons of material to fall on the plant floor; and mistakenly deployed tarps or a previous partial load, again causing massive amounts of material to fall onto the plant floor. The alarm system reduces spillage onto the floor because the radar detector sees the bed height replaced by the floor and stops the loading process with only a slight amount of ash-like material to clean up. The ash-like material spillage is reduced so much via this alarm system that the loading process can continue without cleaning until the end of the loading shift or day.

The driver can clear and respond to various non-fatal alarms of the alarm system without terminally interrupting the loading process. For example and not by limitation, some non-fatal before process alarms detect when there is an obstruction over the vehicle bed or container, when a vehicle tag is not recognized and when a vehicle has recently completed a load. Additional non-fatal before process alarms can be utilized to prevent defects known in the art. Other non-fatal in-process alarms detect when a slump becomes too high, when the vehicle is not positioned under the chute 140, and when the operator stops the loading process. Additional non-fatal in-process alarms can be used to prevent defects known to those skilled in the art.

The system also provides fatal alarms that require supervisory attention before the process can proceed. Some fatal in-process alarms detect when there is a liquid pressure or flow loss in the system, when there is an ash-like material flow loss, when mill failure occurs, when the bin isolation valve is closed, when the emergency stop button is pushed and when the process takes more than the an acceptable amount of time. Additional fatal alarms are utilized after load process completion to prevent defects known in the art. Other fatal after load process alarms detect when there is a liquid pressure loss, when liquid flow is present, when ash-like material flow is present, and when the bin isolation valve is open. Additional fatal in-process alarms can be used to prevent defects known to those skilled in the art.

Figure 10:
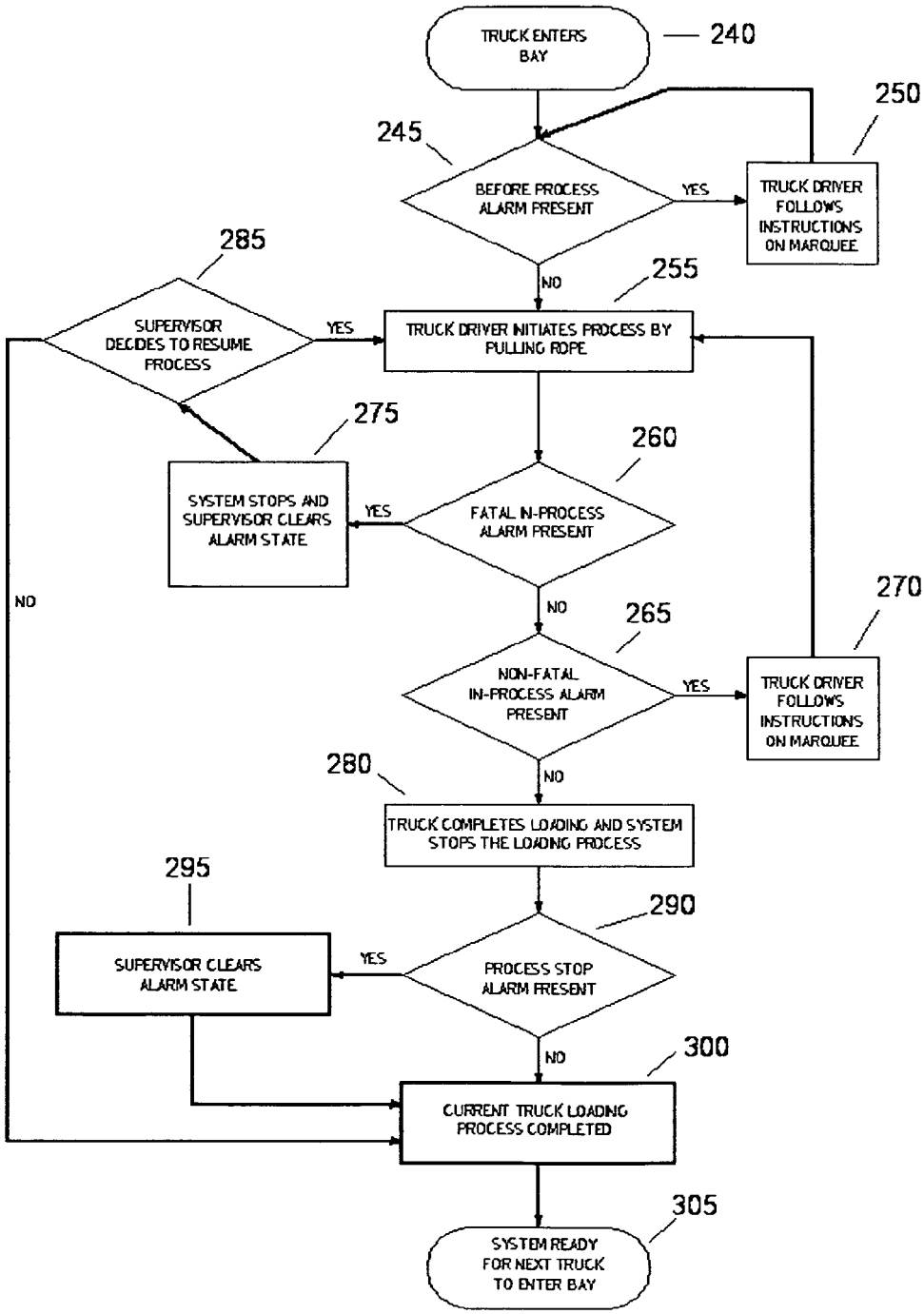
FIG. 10 illustrates a flow chart describing the alarm system of the present invention.

Referring now to FIG. 10, an example a preferred embodiment of the alarm system in practice is disclosed. First, the truck enters the bay 240. If a before process alarm is present 245, the driver follows the instructions on the marquee 250. If a before process alarm is not present, the truck driver initiates the process by pulling the rope 255. Then, if a fatal in-process alarm is detected 260, the system stops and the supervisor clears the alarm state 275 to resume the process 285, after the problem is resolved. If a non-fatal in-process alarm is present 265, the truck driver must follow the instructions on the marquee 270 and then re-initiate the process by pulling the rope 255. If a non-fatal in-process alarm is not present, the truck completes loading and the system stops the loading process when the truck is full 280. If the process stop alarm is present 290, the supervisor clears the alarm state 295 once the issue is resolved. If the process stop alarm is not present, the current truck loading process is completed 300 and the system is ready to load the next truck 305.

Truck weight ticketing is another optional component of the present invention that calculates the total loaded truck weight and produces a weight ticket for use by the truck driver at the end of the loading process. In this optional preferred embodiment, empty truck weight is added to the set point data and loaded truck weight is added to the data reported on each load. Total loaded truck weight is calculated for each load and an official ticket printer produces a weight ticket at the end of each loading process and is obtained by the driver as he exits the loading bay. The use of this system depends on state Department of Transportation regulations and how weight is recorded or documented.

Project Hardware Components

The basic automated ash-like material handling system components include, in a preferred embodiment:

- An industrial PC for the central hub
- A control electronics cabinet assembly in each of the loading bays or one for multiple loading bays
- Ash-like material flow meters mounted in the ash-like material piping and connected to the control cabinet
- Liquid flow meters mounted into the liquid piping and connected to the control cabinet
- Sets of initiation signal hardware mounted to a "control rope"
- E-stop assemblies mounted near the "control rope" at the loading area and the pug mill
- Tag readers and applicable mounting hardware
- Signal horns or alarms and applicable mounting hardware
- A liquid control valve
- Digital displays or marquees mounted in ruggedized cabinets
- Ash-like material control valve (alternatively a dry material feeder can be used with or in place of the ash-like material control valve)
- Radar detectors and applicable mounting hardware
- Various connectivity hardware
- Relevant operating software licenses
- Ethernet, Internet or wireless LAN converters and corresponding hardware
- Other optional hardware components known to those skilled in the art The Optional Truck Ticketing components include, in a preferred embodiment:

- Ticket printers mounted in ruggedized cabinets
- Other optional truck ticketing components known to those skilled in the art System Functions as the Driver Sees them, in a Preferred Embodiment:

- Truck driver enters bay, aligns the truck, and pulls rope to initiate the ash-like material loading process (or the operator starts the process)
- Signal light activates or a marquee displays activation
- Conditioned ash-like material loads into the truck with dry mix towards the bottom of each slump
- Driver watches relative (and truck customized %) measure of truck fill progress on a digital display or marquee
- Driver pulls forward when display or marquee approaches 100% and alert horn sounds or sensor activates or when marquee says "move truck" or the like
- On the last slump, the driver or operator pulls rope when display approaches 100% to complete loading process or lets the system load to max
- Driver exits the loading bay when the signal light activates or when the marquee says "load completed" or the like
- Other optional steps known to those skilled in the art Primary System Components, in a Preferred Embodiment

- HMI
- Liquid flow meter
- Gravimetric mass flow meter
- Level sensor
- PLC
- The pug mill
- Other optional components known to those skilled in the art Other System Components in a Preferred Embodiment

- Digital display or marquee
- Tag reader
- Ash-like material control valve or material feeder
- Warning horn/lights/alarms/sensors
- Additional E-Stop switch
- The "Rope Switch" (if an operator controlled the process in the old system)
- The liquid control valve
- The ash-like material isolation valves
- The liquid pressure switch Optional weight ticket printer Other optional components known to those skilled in the art The detailed steps the systems performs, as an example only and not by limitation, are detailed below:

1. Start Load Process
   1.1. Operator Pulls Rope

The truck driver has pulled the truck into loading position and only pulls the rope once he is ready to load the first slump. Again, the process can optionally be started by an operator or other automatic system. If this is the first slump, then the truck is in the initial loading position. Alternatively, this could also be the startup of the first slump after the supervisor has cleared the Lockout state from the Human Machine Interface (HMI).

1.2. Read truck tag and determine process status
      1.2.1. Read tag for current truck
      1.2.2. Determine if current truck is new-process or in-process
         1.2.2.1. If new-process, go to 1.3
         1.2.2.2. If in-process
            1.2.2.2.1. Check full truck variable, like loading capacity
            1.2.2.2.2. If true, go to alarm A13
            1.2.2.2.3. If false, display "In Process"
            1.2.2.2.4. Go to 1.4
   1.3. Load Truck Parameters and initialize load values
      1.3.1. Store data from previous truck process into database
      1.3.2. Reset truck data registers
      1.3.3. Look-up current truck in the PLC lookup table (the PLC Lookup Table contains the loading recipe for each, individual, truck).
         1.3.3.1. If current truck is not found, go to alarm A10
         1.3.3.2. Otherwise, load truck parameters into active loading registers
      1.3.4. If level is above high bed height limit (BHghtH), go to alarm A12
      1.3.5. Set full truck variable to "FALSE"
      1.3.6. Set marquee timer
      1.3.7. Display "Start at" and initial truck position
      1.3.8. Wait for marquee timeout
   1.4. Check radar detector for incorrect position of truck
      1.4.1. Read radar signal variable (Level) and compare to active loading registers
         1.4.1.1. If level is below low bed height limit (BHghtL), go to alarm A08
         1.4.1.2. If Level is above high slump height limit (SHghtH), go to alarm A09
         1.4.1.3. Otherwise, continue
   1.5. Check liquid pressure
      1.5.1. Read liquid pressure digital input
         1.5.1.1. If liquid pressure below limit (WPressL), go to alarm A01
         1.5.1.2. Otherwise, continue
   1.6. Close ash-like material feed valve
      1.6.1. Read ash-like material feed valve position feedback
         1.6.1.1. If closed, continue
         1.6.1.2. Otherwise close valve
            1.6.1.2.1. Send close signal
   1.7. Open bin isolation valve
      1.7.1. Send signal to open the bin isolation valve and wait for timeout
      1.7.2. Continue
   1.8. Start Pug Mill
      1.8.1. Send start command to Pug Mill
      1.8.2. Read digital running feedback on Pug Mill
         1.8.2.1. If not running, go to alarm A06
         1.8.2.2. Otherwise, continue
      1.8.3. Set load weight accumulation variable to the actual weight start level (WstartA) (the WstartA variable is a calculation of the mass that is in the pug mill. It is used by the feed forward control function during process transitions to calculate the actual mass that is loading into the truck at any one period of time).
         1.8.3.1. Activate load weight accumulation variable using a feed forward control function. (the feed forward control function controls the flow of material based on a time delay offset from the mass flow seen across the ash flow meter. In this way the system controls what goes into the truck instead of what goes into the pug mill).
   1.9. Check pug mill torque overload
      1.9.1. Read analogue or digital current feedback from Pug Mill
         1.9.1.1. If current above limit (MTorqH), go to alarm A07
         1.9.1.2. Otherwise, continue
   1.10. Send signal to open bin isolation valve and wait for timeout
   1.11. Open ash-like material feed valve
      1.11.1. Send open command to the ash-like material feed valve
      1.11.2. Start puff timer
      1.11.3. Start ash-like material feed valve flow timer
         1.11.3.1. When ash-like material flow timeout, continue
   1.12. Look for ash-like material flow
      1.12.1. Read ash-like material flow rate
         1.12.1.1. If ash-like material flow is less than limit (AFlowL), go to alarm 04
         1.12.1.2. Otherwise continue
      1.12.2. When puff timeout, continue
   1.13. Open liquid control valve to suppress puff
      1.13.1. Send open command to the liquid control valve
         1.13.1.1. Open liquid control valve to satisfy dry mix (DMWP) requirements
      1.13.2. Read liquid flow rate
         1.13.2.1. If liquid flow is less than limit (WFlowL), go to alarm 02
         1.13.2.2. Otherwise go to loading state (3.0)

2. EStop process

The emergency stop is initiated by an operator hitting the EStop or similar button or by the machine sensing one of several alarm states.

2.1. EStop initiated by alarm or by operator pushing EStop button.
   2.2. Send long horn blast or activate a sensor
   2.3. Shutdown mill
   2.4. Close liquid valve
   2.5. Send signal to close the bin isolation valve and wait for timeout
   2.6. Close ash-like material feed valve
   2.7. Go to Lock-Out State (4.0)

3. Ash-like material loading process
   3.1. Read slump height from radar detector
      3.1.1. Calculate a new actual weight start level (WstartA)
      3.1.2. If load weight>(load weight limit (LWL) minus dry flush weight) go to 3.4

3.1.3. Start level read timer
3.1.4. Display % slump variable
3.1.5. If slump height<regular mix start level (RMSL) then go to 3.2
3.1.6. If mix shift level (MSL)>slump height>regular mix start level (RMSL) then go to 3.3
3.1.7. If slump height limit (SHghtH)>slump height>mix shift level (MSL) then go to 3.2
3.1.8. If slump height is above high slump height limit (SHghtH), go to 3.5

3.2. Produce Dry Mix
3.2.1. Open ash-like material feed valve to dry mix ash setting (DMAS)
3.2.2. Read ash-like material flow from flow meter
3.2.3. Continually adjust liquid valve to dry mix liquid proportion (DMWP)
3.2.4. Wait for level read time out
3.2.5. Go to 3.1

3.3. Produce regular mix
3.3.1. Open ash-like material feed valve to regular mix ash-like material setting (RMAS)
3.3.2. Read ash-like material flow from flow meter
3.3.3. Continually adjust liquid valve to regular mix liquid proportion (RMWP)
3.3.4. Wait for level read time out
3.3.5. Go to 3.1

3.4. Truck is full
3.4.1. Set full truck variable to TRUE
3.4.2. Start truck full display timer
3.4.3. Display "Truck Full"
3.4.4. Go to 8.0, dry flush process 3.5. High slump shut-off
3.5.1. Send signal to close the bin isolation valve and wait for timeout
3.5.2. Close ash-like material feed valve
3.5.3. Turn off Pug Mill
3.5.4. Close liquid valve
3.5.5. Go to alarm A09

4. Lock-out clearing process

Some alarm states require a supervisor to check the system before it can be restarted. After the supervisor has checked the system, he or she can electronically unlock the system using this process.

4.1. Supervisor clears the lockout for a specific bay using HMI 4.2. Supervisor chooses to resume or restart
4.2.1. If resume
4.2.1.1. Go to ready state
4.2.2. If restart
4.2.2.1. Clear truck and loading registers
4.2.2.2. Go to ready state 5. System purge lockout process System purge is usually done at the end of the loading day to clean the mill with liquid flush and then electronically lock out the mill in preparation for the start process on the following day.

6. Start from system purge lockout process

This process is used to start each loading day. The supervisor must authorize the start-up of any one bay.

6.1. Supervisors re-enables (system purge lockout bit to "OFF") the system using an HMI 6.2. Marquee displays "Ready"

6.3. Initiate ready state 6.4. Close mill drain 6.5. Load WstartA with negative number for mill prime 7. Supervisor's truck and tag introduction process Each truck is loaded to a custom recipe that must be entered into the system the first time that the truck is introduced to the system. The supervisor uses this process to introduce a new truck to the system.

7.1. Supervisor waits until bay is ready and clear of any trucks 7.2. Supervisor enters into truck introduction for a specific bay using HMI
7.2.1. Truck learning variable is set to TRUE 7.3. Truck driver pulls truck into loading position for first slump
7.3.1. Read truck tag and enter it into the appropriate registers of the PLC
7.3.2. Store data from previous truck process into database
7.3.3. Set full truck variable to FALSE
7.3.4. Initialize load weight limit (LWL) to LWLStart (a very high number that is designed not to trip during this learning sequence)

7.4. Supervisor enters the truck rail height and the initial truck position into HMI
7.4.1. System calculates SHghtH by multiplying rail height by RailtoSlmp (a ratio variable)
7.4.2. Reads actual bed level and subtract BedTol (a variable=about 5% at start) to get BHghtL.
7.4.3. Load BHghtL and SHghtH into the appropriate PLC registers 7.5. Supervisor pulls rope to start the slump
7.5.1. Go to 1.4 and continue from this point once slump level reaches SHghtH and attains a READY state.
7.5.2. If truck is now full, then supervisor sets full truck variable to TRUE at the HMI and continue to 7.6.
7.5.3. Otherwise, move truck to next position
7.5.4. Supervisor enters the new truck position into the HMI
7.5.5. Continue to 7.5

7.6. Read the current load weight and store it to the load weight limit (LWL) register.

7.7. Reset learning variable to FALSE 7.8. HMI asks supervisor to verify a successful load
7.8.1. If YES, then store all truck variables to the database
7.8.2. If No, then go to a READY state 8. Dry mix flush sequence The dry mix flush fills clears the mill of all other material and leaves a gradient of dry mix in the mill before mill shutdown. The mill is then stopped with only a small amount of dry mix for the motor to work against during the next motor start up. The next truck receives dry mix as the first ash-like material coming from the chute. At the end of the dry mix flush, the ash-like material feed valve closes (slowly) using a control function that does not tax the response of the system components thereby yielding a more optimal fill result.

8.1. Set to dry mix and slowly close the ash bin isolation valve
8.1.1. Open ash-like material feed valve to dry mix ash setting (DMAS)
8.1.2. Read ash-like material flow from flow meter
8.1.3. Continually adjust water valve to dry mix liquid proportion (DMWP)
8.1.4. Close bin isolation valve using gradient function while calculating the new actual weight start level (WstartA) until completely closed. (the dry mix fill of the pug mill is accomplished by a function that tapers off the flow of the ash-like material into the mill to accomplish two results: 1) push the regular mix out of the other end of the mill and into the truck in a measured way. 2) accurately know how much the weight of dry mix is in the mill using the calculation of the WstartA variable. If the process is terminated before the dry mix flush can be completed (by an operator stop or an interrupt stop), then WstartA is still a valid measure and the system remembers how many seconds of regular mix will flow through the pug mill before the dry mix appears.

8.2. Shut down and determine when state to end in.

8.2.1. Close ash-like material feed valve 8.2.2. Turn off Pug Mill 8.2.3. Close liquid valve 8.2.4. If full truck variable is TRUE go to 8.3

8.2.5. If alarm state is in effect, the go to the following state of that alarm.

8.3. Full load finish 8.3.1. Full truck display timeout 8.3.2. Display "Ready" on the marquee 8.3.3. Initiate ready state

I claim:

1. A method of loading and conditioning a material during loading comprising the steps of:

adding liquid material and dry material as the loading begins;

sensing speed and slump progression through the use of a radar detector;

calculating a mix shift level based on the speed and the slump progression; and restricting flow of the dry material as the loading reaches a target weight to form a gradient of liquid concentration to be loaded across each slump with respect to slump height.

2. The method of claim 1, wherein the sensing is accomplished by means of a radar detector.

3. The method of claim 2, wherein the radar detector senses slump weight and reaches the mix shift level and the loading continues with liquid added to a regular mix proportion.

4. The method of claim 1, wherein the material is an ash-like material.

5. The method of claim 1, further comprising a step of mounting a dry flow measuring device in line with a vertical drop of the material below a material control valve, and dynamically controlling liquid density of the material to suppress dust and prevent formation of slurry.

6. The method of claim 1, further comprising a step of adding a wet blanket of the material on top of each the slump to allow a bottom of each the slump to be initially drier, to prevent the material from becoming airborne during transport and to prevent slurry formation.

7. The method of claim 1, further comprising a step of indicating to a driver a percentage of slump height during the loading.

* * * * *